US006422425B1

(12) United States Patent
Tada

(10) Patent No.: US 6,422,425 B1
(45) Date of Patent: Jul. 23, 2002

(54) LIQUID DISCHARGING APPARATUS

(75) Inventor: Tetsuya Tada, Tokyo (JP)

(73) Assignee: Canyon Co., Ltd., Tokyo (JP)

( * ) Notice: Subject to any disclaimer, the term of this patent is extended or adjusted under 35 U.S.C. 154(b) by 0 days.

(21) Appl. No.: 09/710,408

(22) Filed: Nov. 9, 2000

(30) Foreign Application Priority Data

Dec. 13, 1999 (JP) ..... 11-352679
Aug. 11, 2000 (JP) ..... 2000-245382

(51) Int. Cl.[7] ..... B67D 5/42

(52) U.S. Cl. ..... 222/153.07; 222/153.13; 222/321.3; 222/321.9

(58) Field of Search ..... 222/153.06, 153.07, 222/153.13, 321.1, 321.3, 321.7, 321.9

(56) References Cited

U.S. PATENT DOCUMENTS

| | | | | |
|---|---|---|---|---|
| 3,367,540 A | | 2/1968 | Lehmann | |
| 3,403,823 A | * | 10/1968 | O'Donnell | 222/321.9 X |
| 4,318,498 A | * | 3/1982 | Magers et al. | 222/153.13 |
| 4,384,660 A | * | 5/1983 | Palmisano et al. | 222/153.07 |
| 4,511,064 A | * | 4/1985 | Ruscitti et al. | 222/153.06 |
| 4,809,878 A | * | 3/1989 | Rainey | 222/321.9 |
| 4,887,744 A | * | 12/1989 | Williams | 222/153.13 X |
| 5,040,702 A | * | 8/1991 | Knickerbocker et al. | 222/153.07 |
| 5,503,302 A | | 4/1996 | DeJonge | |
| 5,975,370 A | * | 11/1999 | Durliat | 222/153.06 |
| 6,223,954 B1 | * | 5/2001 | Carow | 222/321.7 X |

FOREIGN PATENT DOCUMENTS

| | | |
|---|---|---|
| EP | 0 274 877 A1 | 7/1988 |
| GB | 1 036 955 | 7/1966 |
| GB | 2 081 396 | 2/1982 |
| JP | 2 589 452 | 11/1998 |

* cited by examiner

*Primary Examiner*—Kenneth Bomberg
(74) *Attorney, Agent, or Firm*—Flynn, Thiel, Boutell & Tanis, P.C.

(57) ABSTRACT

A liquid discharging apparatus having a simple construction and capable of reducing the number of components with high efficiency is provided. The liquid discharging apparatus for discharging a liquid contained in a container from a nozzle head that is mounted on a cap attached to an opening of the container and is movable up and down together with a piston is characterized in comprising a virgin seal body positioned around a piston engagement hole formed on the cap and integrated with the cap so as to be separable from the cap by way of a thin portion, a vertical slit defined in the virgin seal body and having a pinch portion provided with a slip stopping portion at the opened portion thereof, wherein the nozzle head is fixed to its top dead center by the virgin seal body when the liquid discharging apparatus is not used.

19 Claims, 13 Drawing Sheets

LIQUID DISCHARGING APPARATUS

BACKGROUND OF THE INVENTION

1. Field of the Invention

The invention relates to a pump type liquid discharging apparatus capable of manually discharging or atomizing a fluid having high viscosity such as shampoos or fluid having low viscosity such as cosmetics, and particularly relates to a virgin seal body of the liquid discharging apparatus for keeping the liquid discharging apparatus virgin, namely, in an unused state.

2. Background of the Invention

A conventional liquid discharging apparatus such as a pump dispenser and so forth is provided with means for fixing a nozzle head so as not to move to prevent a liquid in a container from being discharged erroneously from the nozzle head while transporting it before it is used.

Meanwhile, a virgin seal is employed for proving that the liquid discharging apparatus is not at all used, namely, proving a so-called unused state.

There are generally two types of fixed means of the virgin seal, one type is to temporarily fix a nozzle head to a cap or the like at the bottom dead center thereof, and another type is to temporarily fix the nozzle head to the cap or the like at the top dead center thereof. The nozzle head is released from the fixation to the cap by these two types of fixed means when the liquid discharging apparatus is used so that the liquid discharging apparatus is placed in a usable state.

Particularly, since the fixed means for temporarily fixing the nozzle head at the top dead center does not render a spring body built into the liquid discharging apparatus in an extremely compressed state, the effectiveness of the spring body is always maintained, and hence this fixed means is considered more useful compared with the fixed means for temporarily fixing the nozzle head at the bottom dead center.

The liquid discharging apparatus disclosed in Japanese Utility Model Registration No. 589 452 discloses an example of the fixed means for temporarily fixing the nozzle head at the top dead center. A cylindrical stopper for preventing a movable side guide cylinder that is a peripheral body of a pressing head contacting the outer surface of a fixed side guide cylinder from lowering is provided on an outer surface of the fixed side guide cylinder. The fixed side guide cylinder stands upright from the upper surface of a screw cap at one side thereof to which a liquid discharging apparatus body is fixed, and the cylindrical stopper has a hinge formed of a thin plate for ripping use, and a pinch portion protruding from the outer surface thereof at the other side while a part of the cylindrical stopper is separated so as to be opened one way by way of the hinge. The cylindrical stopper engages with the fixed side guide cylinder from the outside, and after engagement between the cylinder stopper and the fixed side guide cylinder from the outside, the separating portion of the part of the cylindrical stopper is connected and fixed to the other portion of the cylinder stopper so as to lock the pressing of the pressing head.

However, in the conventional liquid discharging apparatus, the cylindrical stopper is engaged between the movable side guide cylinder and the screw cap from the outside but it is formed of an element independent of the liquid discharging apparatus. Since the cylindrical stopper is independent of the other parts of the liquid discharging apparatus, the number of parts of the liquid discharging apparatus increases as a whole, and also the number of assembly steps for the parts increases. Such a cylindrical stopper is complex in shape and a mold for manufacturing the cylindrical stopper is expensive.

SUMMARY OF THE INVENTION

In view of the problems of the conventional liquid discharging apparatus, it is an object of the invention to provide a liquid discharging apparatus having a simple construction and capable of reducing the number of parts or components thereof with high efficiency.

The inventor of this application endeavored himself to study the problems of the conventional liquid discharging apparatus and has found that a virgin seal body can be integrated with a cap so as to be separable therefrom, based on which the invention has been completed.

That is, a first aspect of the invention resides in a liquid discharging apparatus for discharging a liquid contained in a container 1 from a nozzle head 3 that is mounted on a cap 2 attached to an opening of the container 1 and is movable up and down together with a piston 5. A virgin seal body 11 is integrated with the cap 2 so as to be separable therefrom for preventing the nozzle head 3 from moving downward.

A second aspect of the invention resides in a liquid discharging apparatus for discharging a liquid contained in a container 1 from a nozzle head 3 that is mounted on a cap 2 attached to an opening of the container 1 and is movable up and down together with a piston 5. A virgin seal body 11 is integrated with the cap 2 and positioned around a piston engagement hole 2*a* formed on the cap 2, wherein the nozzle head 3 is fixed to its top dead center by the virgin seal body 11 when the liquid discharging apparatus is not used.

A third aspect of the invention resides in the liquid discharging apparatus wherein the virgin seal is cylindrical and is connected to the cap 2 by way of a thin portion 11A formed along the piston engagement hole 2*a*.

A fourth aspect of the invention resides in the liquid discharging apparatus further comprising a vertical slit 12 defined in the virgin seal body 11 and having a pinch portion 13 at an opened portion thereof.

A fifth aspect of the invention resides in the liquid discharging apparatus further comprising a slip stopping portion 14 at least on an outer peripheral surface of the virgin seal body 11 having the pinch portion 13.

A sixth aspect of the invention resides in the liquid discharging apparatus wherein the pinch portion 13 has a cornered portion 13*a* that stands upright.

A seventh aspect of the invention resides in the liquid discharging apparatus wherein the virgin seal body 11 has a thin portion 11A having a notch 11B so that the virgin seal body 11 can be easily separated from the cap 2.

An eighth aspect of the invention resides in the liquid discharging apparatus wherein the virgin seal body 11 has a tab T serving as a pinch portion 13 and extended therefrom at the opened portion of the vertical slit 12 so as to be easily pinched.

A ninth aspect of the invention resides in the liquid discharging apparatus further comprising a valve seal body 51A provided on a valve seat 51 formed in the piston 5, said valve seal body 51A being separable from the valve seat 51 when a valve 8 inside a housing 4 attached to the cap 2 moves upward.

A tenth aspect of the invention resides in a liquid discharging apparatus for discharging a liquid contained in a container 1 from a nozzle head 3 that is mounted on a cap 2 attached to an opening of the container 1 and is movable up and down together with a piston 5. A virgin seal body 11 is positioned around a piston engagement hole 2*a* formed on the cap 2 and integrated with the cap 2 so as to be separable from the cap 2 by way of a thin portion 11A, a vertical slit 12 is defined in the virgin seal body 11 and has a pinch portion 13 provided with a slip stopping portion 14 at the opened portion thereof, and the nozzle head 3 is fixed to its top dead center by the virgin seal body 11 when the liquid discharging apparatus is not used.

The liquid discharging apparatus of the invention has the virgin seal body 11 integrated with the cap 2 around the piston engagement hole 2*a* formed on the cap 2. The virgin seal body 11 is formed cylindrically and it is connected to the cap 2 by way of the thin portion 11A of the virgin seal body 11 along the piston engagement hole 2*a*. When the liquid discharging apparatus is used, the pinch portion 13 is pulled to rip the thin portion, so that the virgin seal body 11 can be easily and properly removed.

It is a matter of course to employ the construction combining not less than two of the inventions selected from the first to tenth aspect of the inventions.

BRIEF DESCRIPTION OF THE DRAWINGS

FIG. 11(A) and FIG. 11(B) are enlarged views of a part in FIG. 10, wherein FIG. 11(A) is a sectional view and FIG. 11(B) is a plan view;

FIG. 13(A) and FIG. 13(B) are enlarged views of a part in FIG. 12, wherein FIG. 13(A) is a sectional view and FIG. 13(B) is a plan view.

PREFERRED EMBODIMENT OF THE INVENTION

First Embodiment (FIGS. 1 to 4):

A liquid discharging apparatus according to a first embodiment of the invention is now described with reference to FIGS. 1 to 4.

Figure 1:
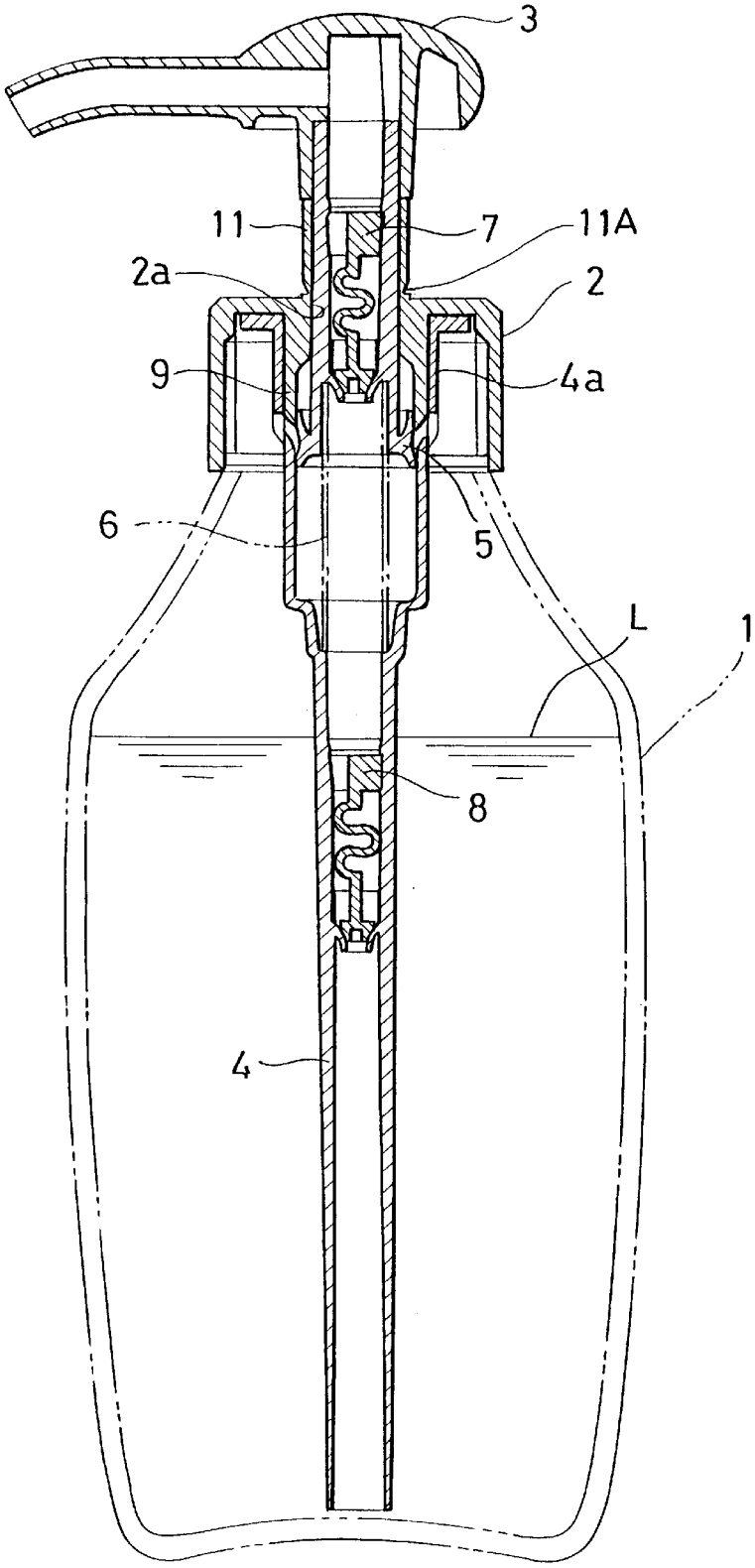
FIG. 1 is a view showing the entire construction of the liquid discharging apparatus according to a first embodiment of the invention.

FIG. 1 shows the entire construction of the liquid discharging apparatus. The liquid discharging apparatus in FIG. 1 is held virgin, namely, in an unused state by a virgin seal body, described later.

In FIG. 1, depicted by 1 is a container in which a liquid L is contained, 2 is a cap attached to the opening of the container 1, 3 is a nozzle head that is mounted on the cap 2 to be movable up and down together with a piston 5. When the nozzle head 3 is moved up and down, the liquid L in the container 1 can be discharged outside.

Depicted by 4 is a housing connected to the inner side of the cap 2 and hung down in the container 1. The piston 5 is integrated with the lower part of the nozzle head 3 and movable up and down together with the nozzle head 3. Depicted by 6 is a spring for urging the piston 5 upward, 7 is a valve mounted inside the piston 5, and 8 is a valve mounted inside the housing 4.

A piston engagement hole 2*a* is formed on the cap 2 and a hanging ring portion 9 is integrated with the innermost part of the piston engagement hole 2*a*. The housing 4 engages with the ring portion 9 at an upper engaging portion 4*a*. The piston 5 moves up and down while contacting the ring portion 9.

It is a feature of the invention to provide a virgin seal body 11 for preventing the nozzle head 3 from moving downward and it is integrated with the cap 2 to be separable therefrom. That is, the virgin seal body 11 integrated with the cap 2 is provided around the piston engagement hole 2*a* formed in the cap 2. The nozzle head 3 is not moved downward by the virgin seal body 11 but can be fixed at the top dead center thereof.

That is, as shown in FIG. 1, when the liquid discharging apparatus is not used, the virgin seal body 11 is mounted on the lower end of the nozzle head 3 (see FIG. 2), and hence the nozzle head 3 is not moved downward from the top dead center thereof.

Figure 2:
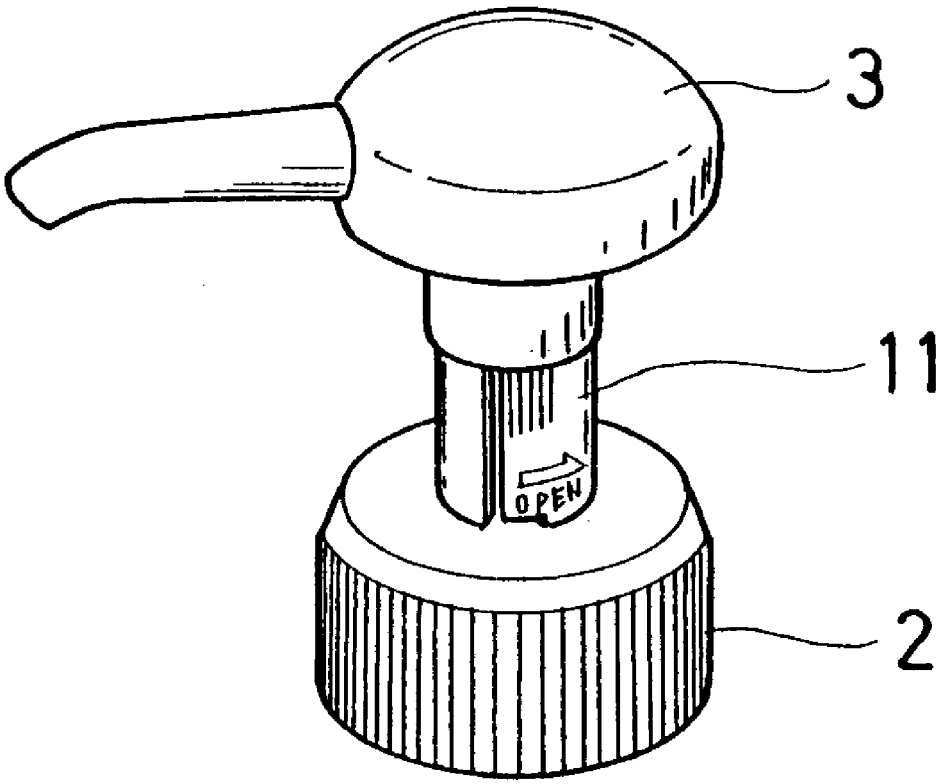
FIG. 2 is an perspective view showing an example of the construction of a virgin seal body and the vicinity thereof in FIG. 1.

As shown in FIGS. 1 and 2, the virgin seal body 11 is preferably formed cylindrically and connected to the cap 2 by way of a thin portion 11A of the virgin seal body 11 along the piston engagement hole 2*a*. The virgin seal body 11 can be easily separable from the cap 2 at the thin portion 11A because the thin portion 11A is weak in strength.

A notch 11B is formed (see FIG. 3) on a part of the thin portion 11A to be caught by fingers for the preparation of separation, whereby the virgin seal body 11 is easily separated from the cap 2. It is not always necessary to provide the notch 11B. The virgin seal body 11 has a diameter substantially the same as the lower end portion of the nozzle head 3 and it is preferable not to protrude outward.

Figure 3A:
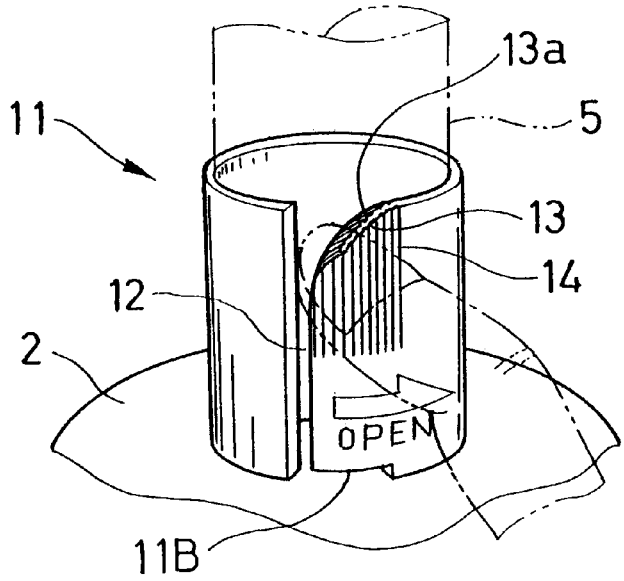
FIG. 3(A) and FIG. 3(B) are perspective views showing an example of the construction of the virgin seal body and a ripping state of the virgin seal body.

FIG. 2, FIG. 3(A) and FIG. 3 respectively show the construction of a virgin seal body and the vicinity thereof.

A vertical slit 12 is defined in the virgin seal body 11, and a finger tip is easily caught by this vertical slit 12. The width of the vertical slit 12 may be made wider only in view of the object thereof, namely, only for meeting the object of preventing the nozzle head 3 from lowering from the top dead center thereof. That is, it is not always necessary for the virgin seal body to surround the entire surface of the piston but may surround a part of the surface of the piston.

The pinch portion 13 is formed on the vertical slit 12 at the opened portion thereof so as to easily pinch the vertical slit 12. A slip stopping portion 14 is provided on the virgin seal body 11 at least on an outer peripheral surface of the virgin seal body 11 having the pinch portion 13. The slip stopping portion 14 is, for example, formed of an irregularity having vertical strips or ribs or a protrusion having an island shape (not shown). The slip stopping portion 14 may function to prevent fingers from slipping from the pinch portion 13 of the virgin seal body 11.

It is needless to say that the slip stopping portion 14 may be formed on front and back sides of the pinch portion 13 to enhance the slip stopping function. If a cornered portion 13*a* of the pinch portion 13 is formed to stand upright, the pinch portion 13 is more easily pinched by fingers.

Figure 4A:
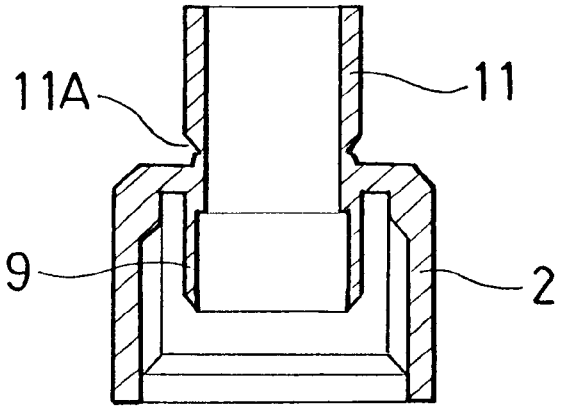
FIG. 4(A) and FIG. 4(B) are views showing the state of connection between the virgin seal body and the cap.
Figure 4B:
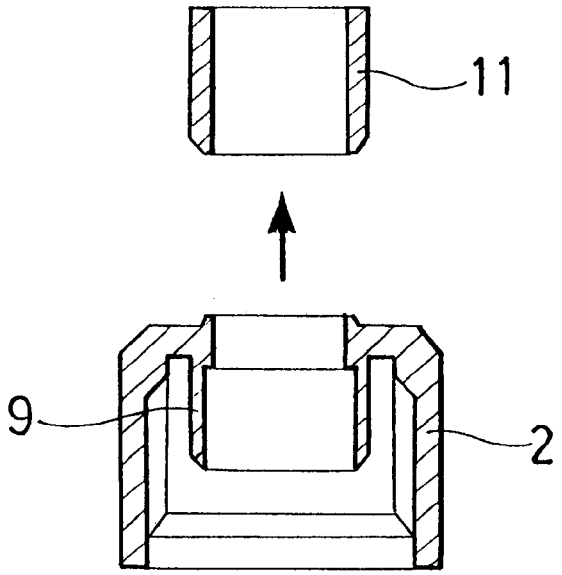

FIG. 4(A) and FIG. 4(B) are views showing the state of connection between the virgin seal body and the cap, from which it is found that the virgin seal body 11 is connected to and integrated with the cap 2 by way of the thin portion 11A.

Figure 5:
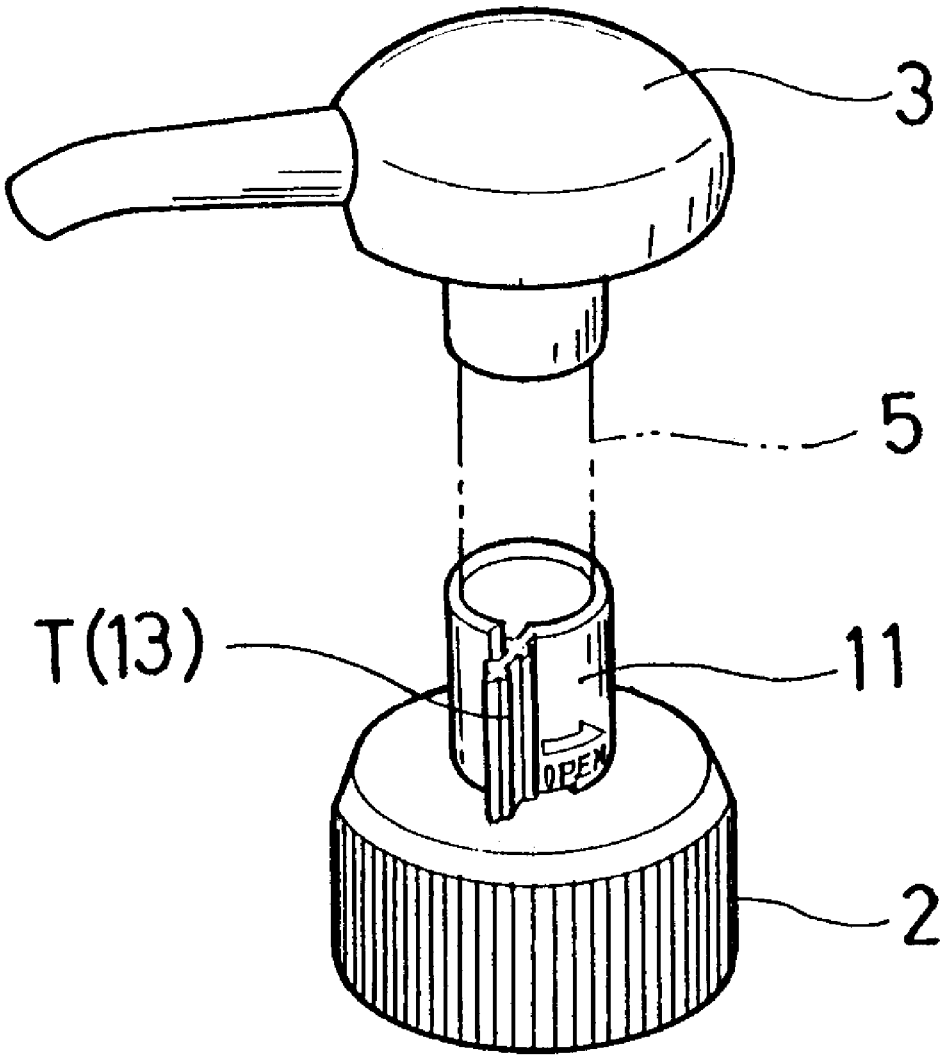
FIG. 5 is an exploded perspective view showing an example of the construction of a virgin seal body and the vicinity thereof according to a second embodiment of the invention.
Figure 6:
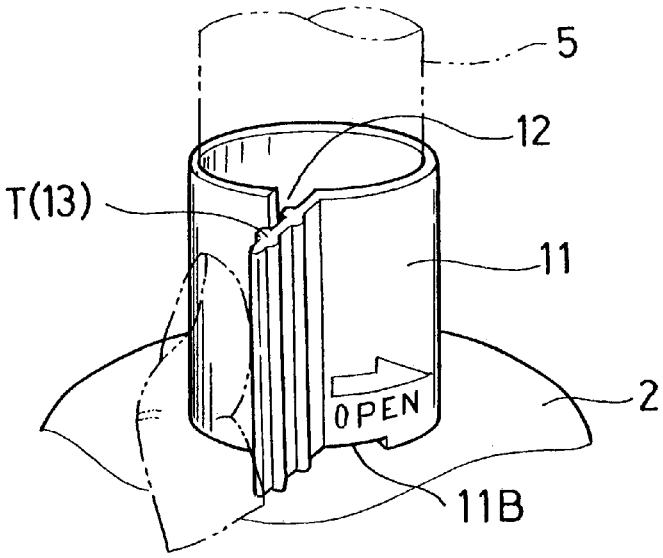
FIG. 6(A) and FIG. 6(B) are perspective views showing an example of the construction of the virgin seal body and a ripping state of the virgin seal body in FIG. 5.
Figure 6:
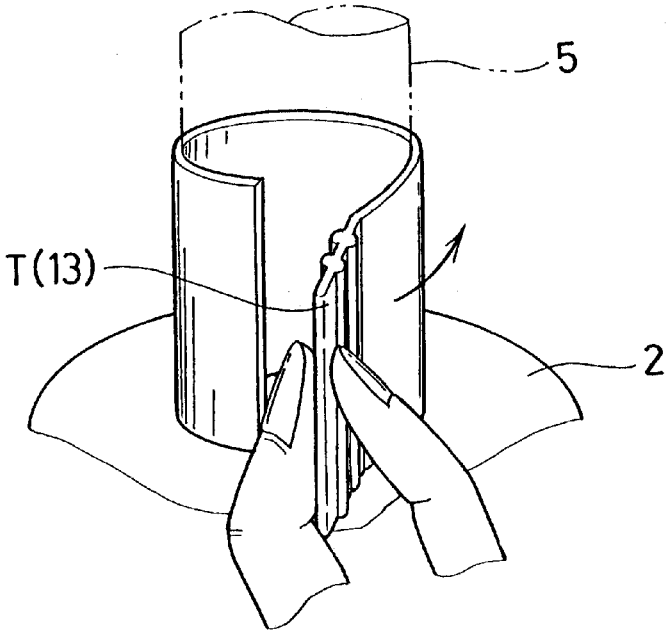

Second Embodiment (FIGS. 5 and 6)

A liquid discharging apparatus according to a second embodiment of the invention is now described with reference to FIGS. 5 and 6.

Components which are the same as those of the first embodiment of the invention as shown in FIGS. 1 to housing 4 are depicted by the same reference numerals.

FIG. 5, FIG. 6(A) and FIG. 6(B) show a modification of another virgin seal body, namely, second embodiment of the invention. In the second embodiment, the virgin seal body 11 has a tab T serving as a pinch portion 13 and extended therefrom at the opened portion of the vertical slit 12 so as to be easily pinched.

If the tab T is pulled by fingers, the virgin seal body 11 is easily removed from the cap 2 [FIG. 6(A)→FIG. 6(B)]. If the tab T has an irregularity having vertical strips or ribs, it can be easily pinched by fingers with high efficiency. In the second embodiment of the invention, the notch 11B is also provided on the part of the thin portion 11A so as to be caught by fingers for the preparation of separation, whereby the virgin seal body 11 is easily separated from the cap 2.

With the arrangement of the liquid discharging apparatus set forth above, it has the virgin seal body 11 integrated with the cap 2. When the parts or components are assembled, the virgin seal body 11 is mounted on the lower end of the nozzle head 3 from which it is understood that the nozzle head 3 is prevented from lowering from the top dead center thereof. Accordingly, when the liquid discharging apparatus is not used, the nozzle head 3 does not lower from the top dead center, and hence the liquid L in the container 1 is not discharged.

Since the virgin seal body 11 is integrated with the cap 2 to be separable therefrom as mentioned above, it can be easily separated and removed from the cap 2 when the liquid discharging apparatus is used. That is, since the virgin seal body 11 is connected to the cap 2 by way of the virgin seal body 11 along the piston engagement hole 2*a*, it can be easily separated from the cap 2 when the liquid discharging apparatus is used.

Figure 3B:
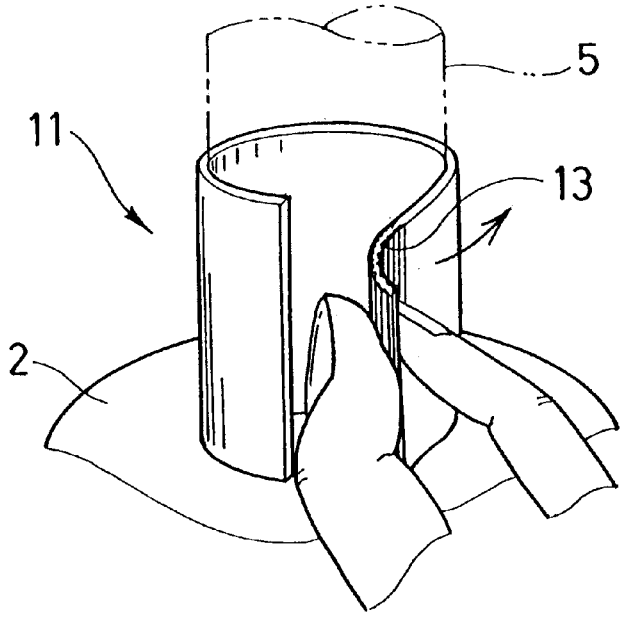

In this case, when the pinch portion 13 is firmly pulled, the thin portion 11A is ripped so that the virgin seal body 11 can be easily and properly removed from the cap 2 [FIG. 3(A)→FIG. 3(B), FIG. 6(A)→FIG. 6(B)].

Figure 7:
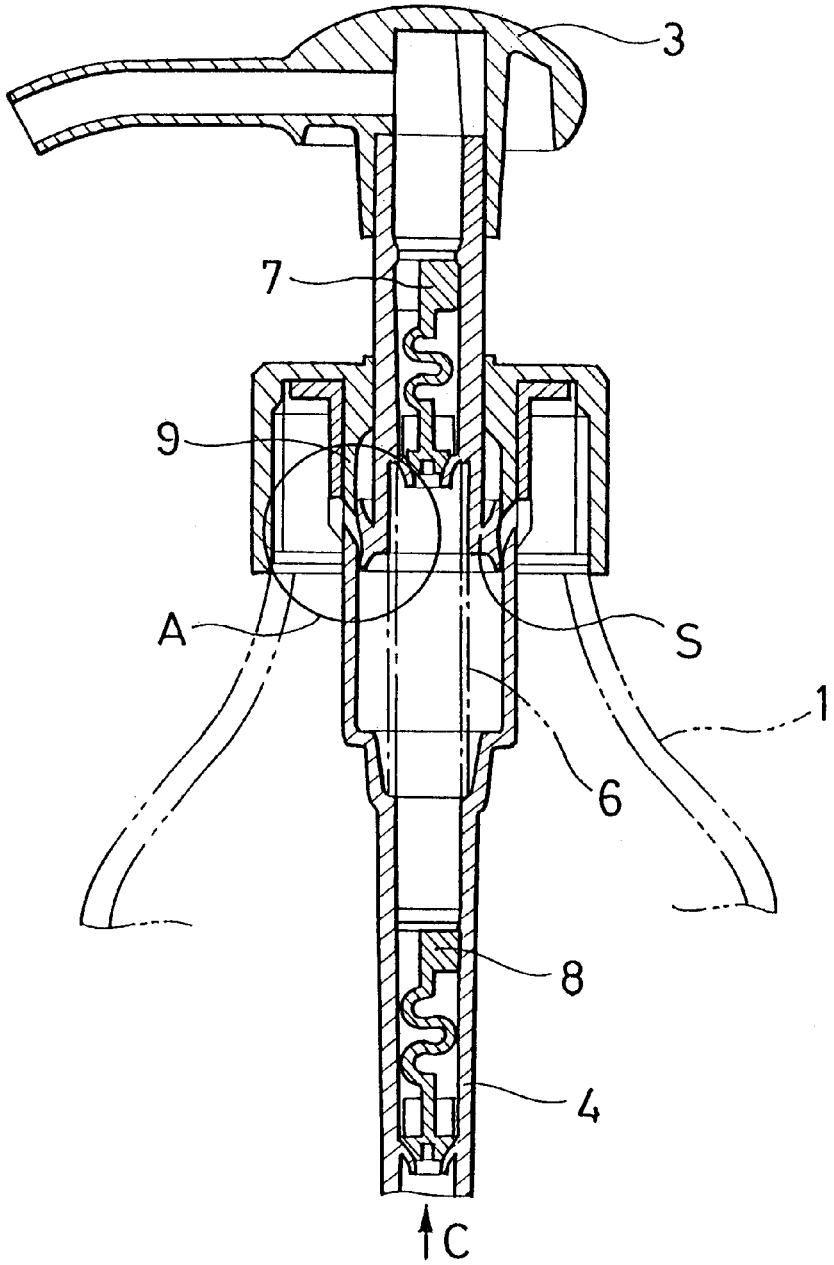
FIG. 7 is a view showing a state where the virgin seal body is removed.
Figure 8:
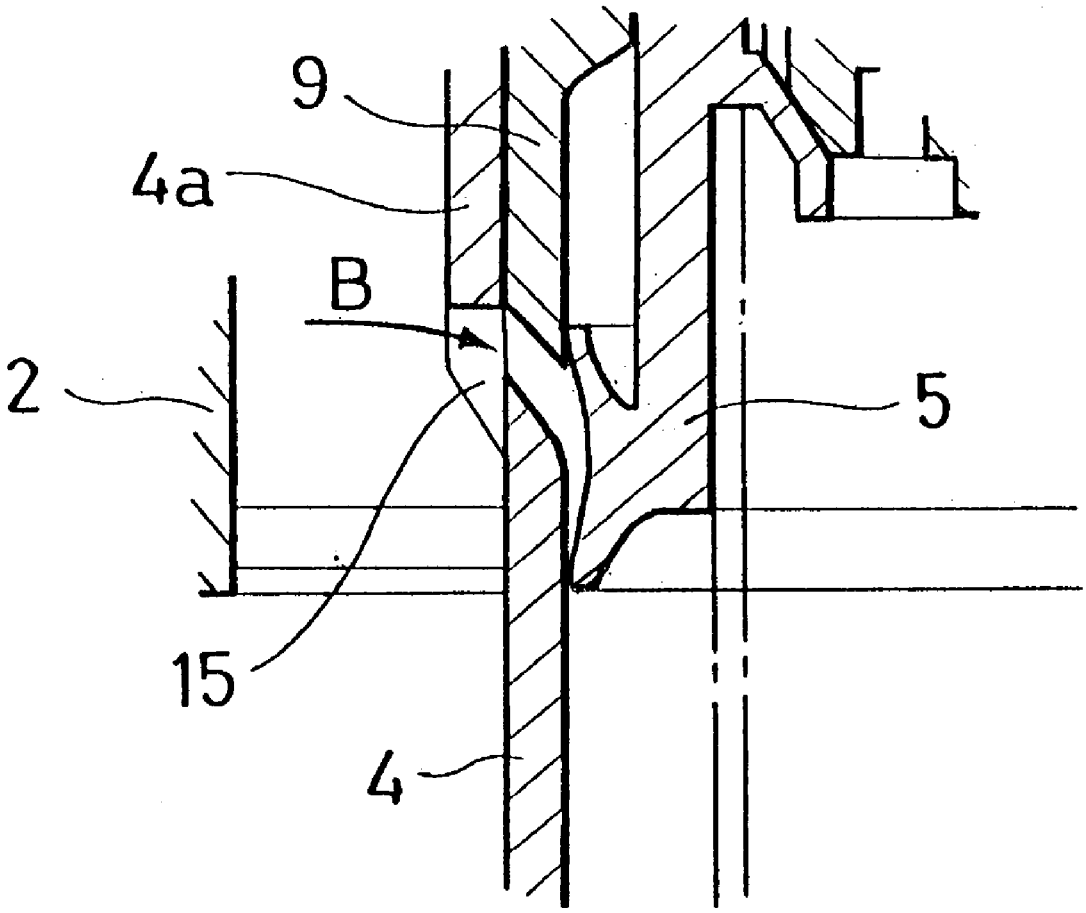
FIG. 8 is a view enlarging the portion A in FIG. 7.

FIG. 7 shows a top dead center of the nozzle head 3. At the top dead center, as shown in FIG. 8, when the piston 5 seals a gap defined between the ring portion 9 and the housing 4, it is possible to prevent the liquid L from entering this gap between the ring portion 9 and housing 4 through a communication hole 15, thereby keeping a liquid-tight state.

Since the valve 7 or valve 8 is formed of a fixed pressure valve, it is possible to prevent the entrance of the liquid L in the direction of the arrow C, if the liquid L has a pressure within a given value, thereby keeping a light-tight state.

Figure 9:
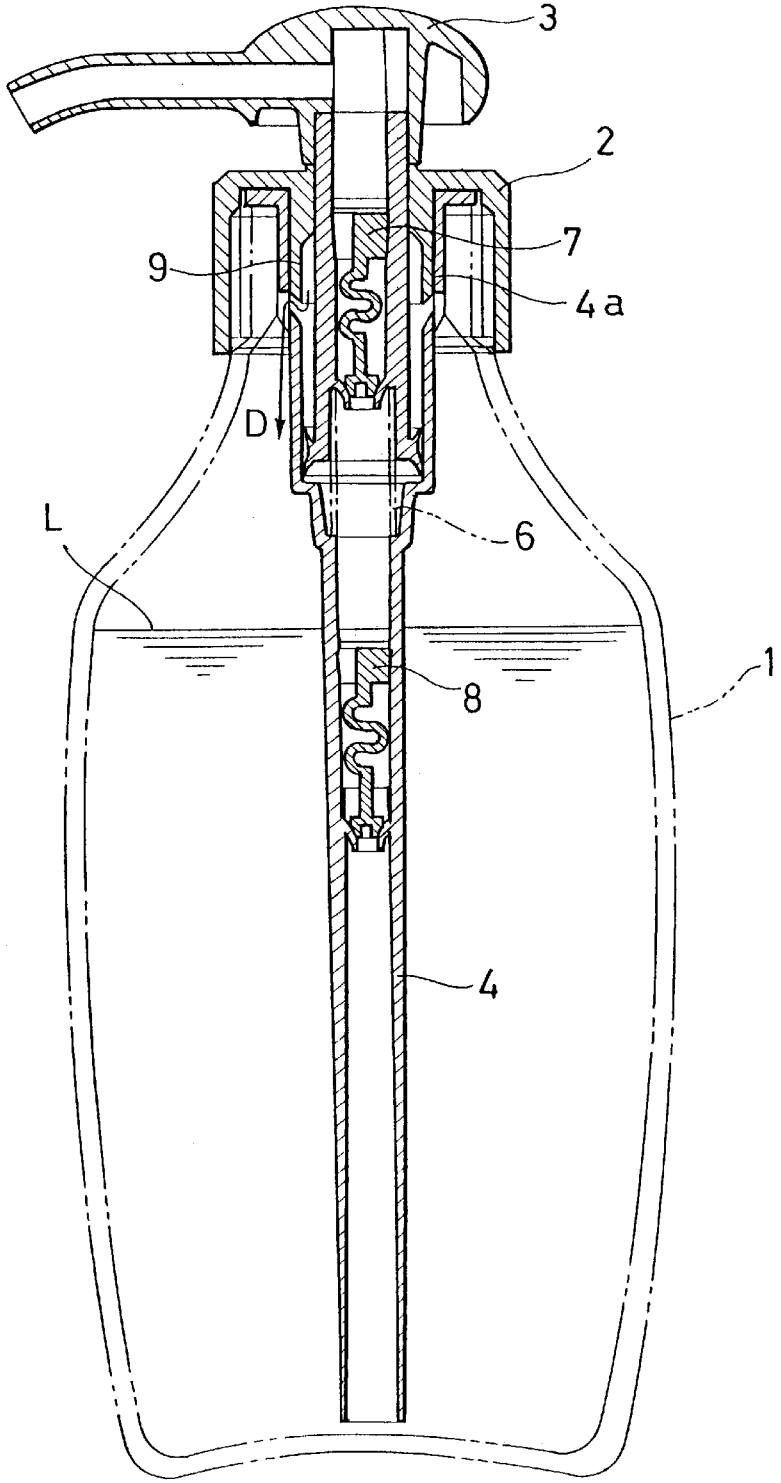
FIG. 9 is a view showing a state where a nozzle head is positioned at the bottom dead center thereof.

In the state shown in FIG. 7, when the nozzle head 3 positioned at the top dead center is pushed downward against the elasticity of the spring 6, the liquid L in the housing 4 is pressurized and discharged through the nozzle head 3 [FIG. 7→FIG. 9]. At this time, a liquid-tight state is released because the container 1 communicates with the open air through the communication hole 15 as shown in the arrow D.

Meanwhile, the virgin seal body 11 can prevent the nozzle head 3 from lowering downward, as mentioned above. However, the virgin seal body 11 is provided outside the container 1, and hence it is prone to be separated carelessly from the cap 2, for example, by a child.

If the nozzle head 3 lowers inadvertently when it contacts something or the liquid discharging apparatus falls over, the liquid L is erroneously discharged.

To prevent such an accident with assurance, an example of the valve seal body for ensuring the safety of the liquid discharging apparatus by the internal construction thereof is explained with reference to FIGS. 10 to 13.

Figure 10:
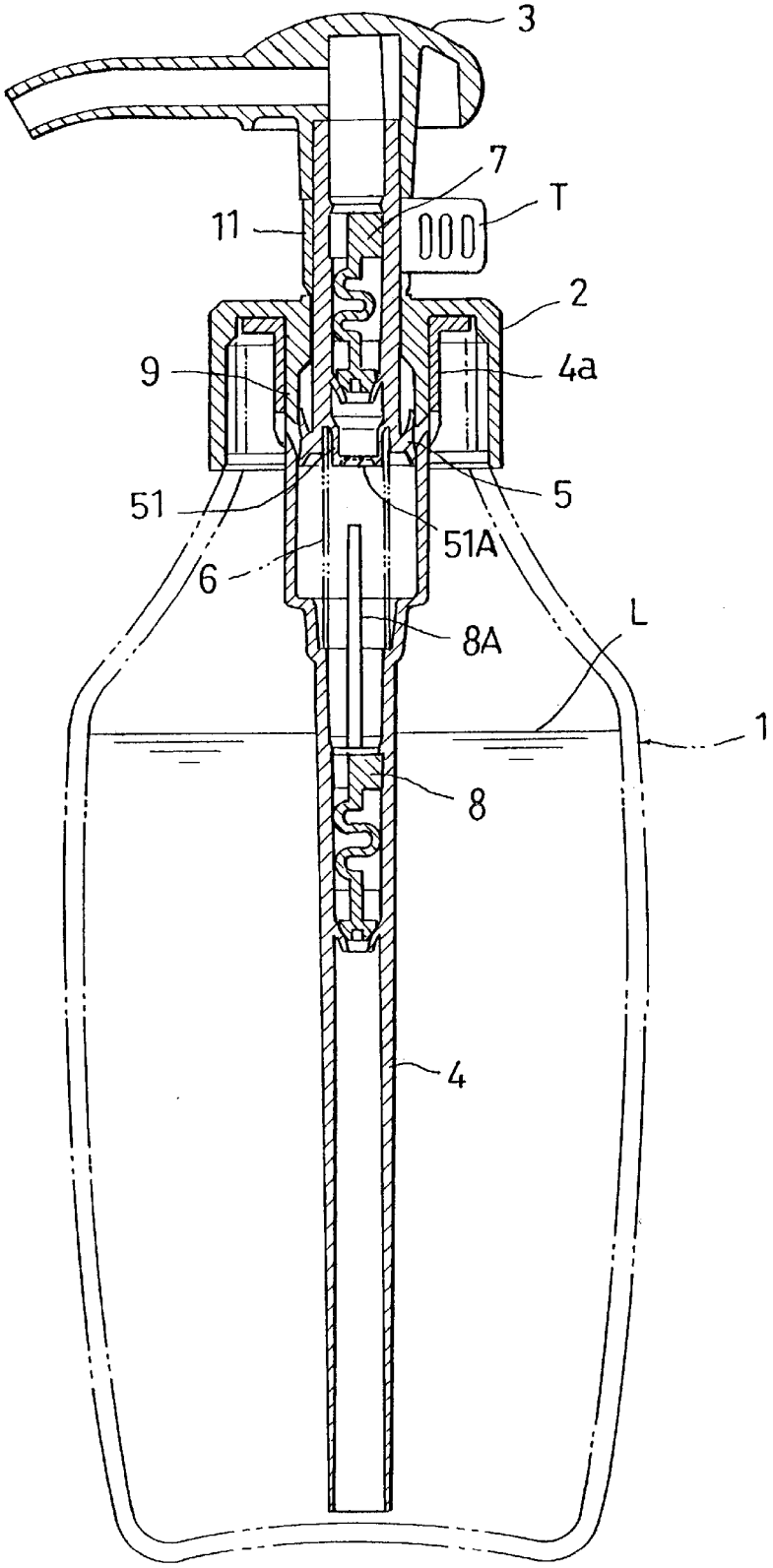
FIG. 10 shows the entire construction of the liquid discharging apparatus wherein the nozzle head is positioned at the top dead center thereof.

FIG. 10 shows the entire construction of the liquid discharging apparatus wherein the nozzle head is positioned at the top dead center thereof.

Figure 11A:
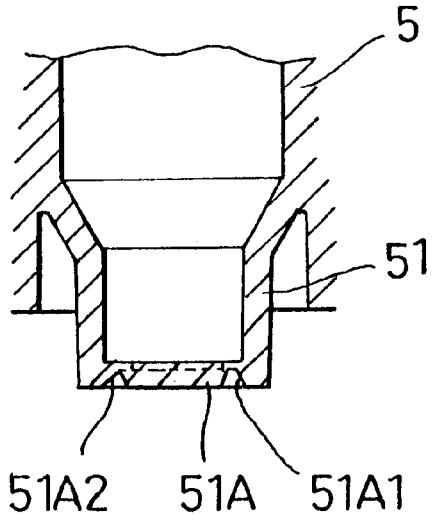
Figure 11B:
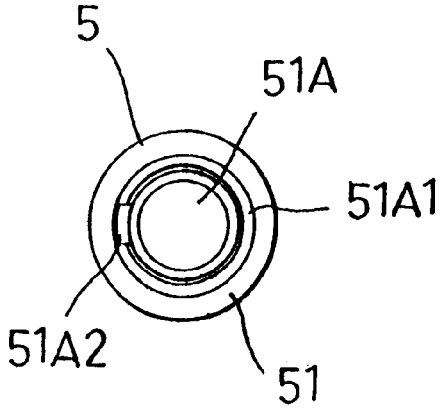

FIG. 11(A) and FIG. 11(B) are perspective views of an enlarged part in FIG. 10, wherein FIG. 11(A) is a sectional view and FIG. 11(B) is a plan view.

The virgin seal body 11 is the one as explained with reference to FIG. 6, but it is not limited thereto, and it is a matter of course that the other virgin seal body 11 shown in FIG. 2, FIG. 3(A) and FIG. 3(B) can be employed.

Figure 12:
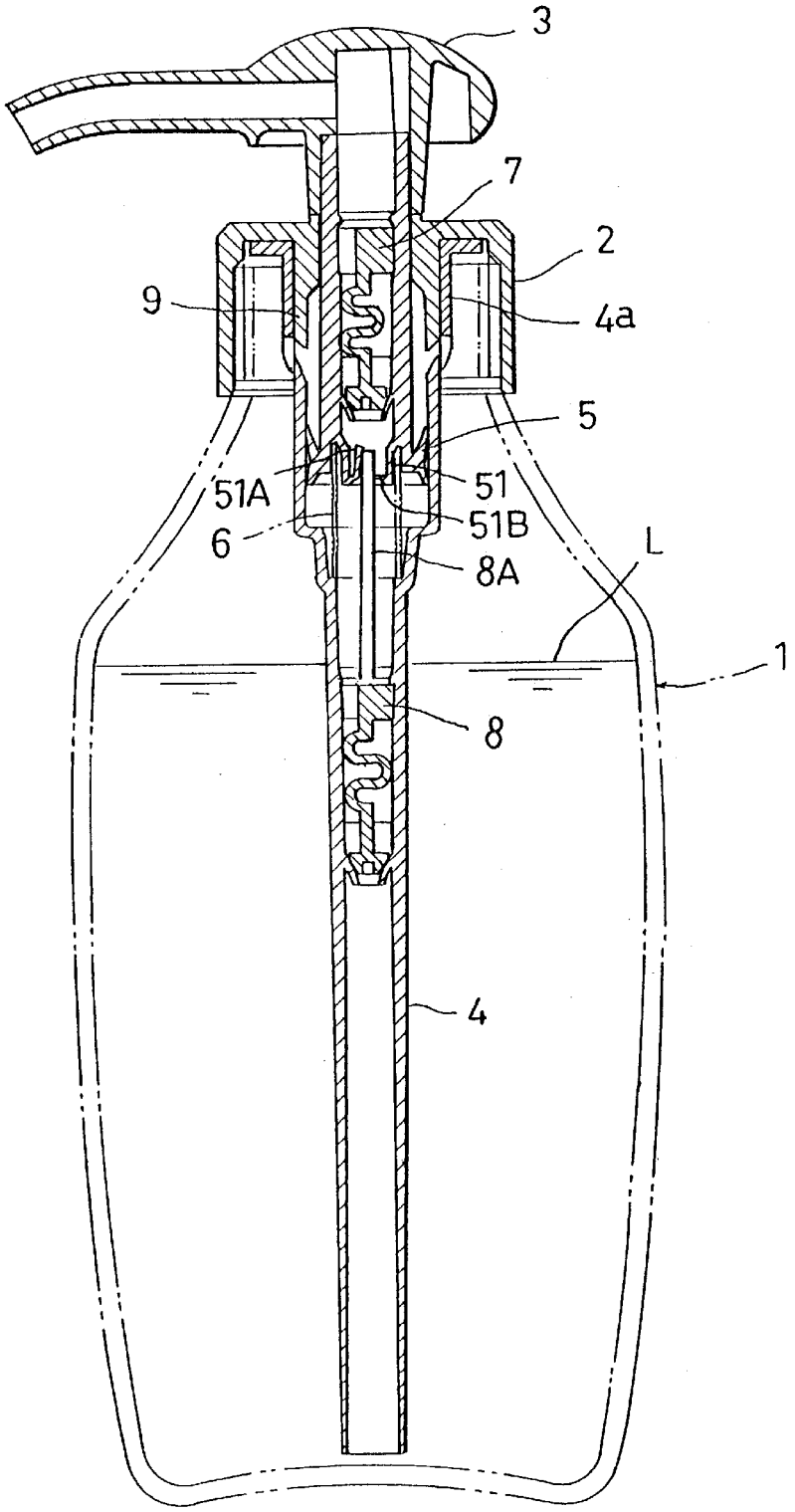
FIG. 12 shows the entire construction of the liquid discharging apparatus wherein the nozzle head is positioned at the bottom dead center thereof.
Figure 13:
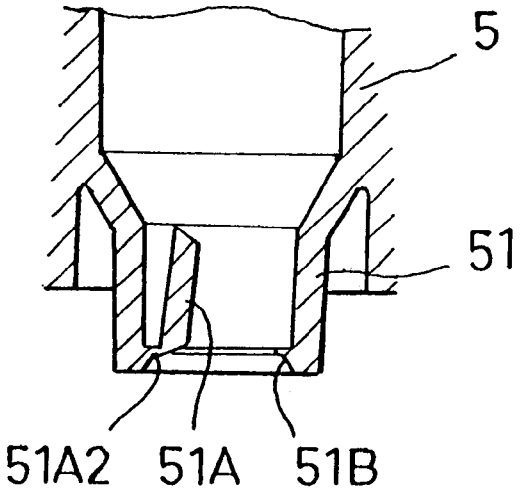
Figure 13:
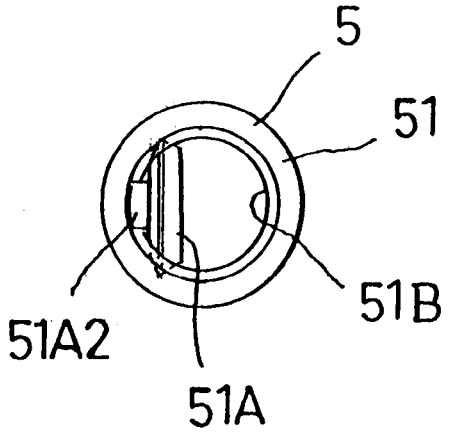

FIG. 12 shows the entire construction of the liquid discharging apparatus wherein the nozzle head is positioned at the bottom dead center thereof.

FIG. 13(A) and FIG. 13(B) are perspective views of an enlarged part in FIG. 12, wherein FIG. 13(A) is a sectional view and FIG. 13(B) is a plan view.

In the internal construction of the liquid discharging apparatus, a valve seat 51 is extended from the piston 5 for allowing the flow of a fluid. The valve seat 51 in FIG. 10 to FIG. 13(B) has a shape that is positively extended compared with that shown in FIG. 1. The valve seat 51 has an opening portion 51B that is closed by a valve seal body 51A when the liquid discharging apparatus is not used.

As shown in FIG. 11, the valve seal body 51A is connected to the valve seat 51 by way of a thin portion 51A1. Since the thin portion 51A1 is weak in strength, the valve seal body 51A can be easily separated from the valve seat 51 at the thin portion 51A1.

A part of the thin portion 51A1 has a thick portion 51A2 that is strong in strength and is hardly separated at this point so that the valve seal body 51A can be connected to the valve seat 51. Accordingly, the valve seal body 51A is not completely separated from the valve seat 51.

The valve seal body 51A is separated by a tip end portion 8A that is extended upward from the valve 8. The tip end portion 8A is extended from the tip end of the valve 8 and integrated therewith.

The length of the tip end portion 8A is set to the extent that the valve seal body 51A can be separated with certainty when the valve seal body 51A is pushed upward from the lower portion in the case that the nozzle head 3 is pressed downward to reach the bottom dead center as shown in FIG. 12, but it has a length not to reach the valve 7. The thickness of the tip end portion 8A is set to be slightly smaller than the size of opening portion 51B of the valve seat 51.

When the liquid discharging apparatus is set to be usable, the tab T is pinched by fingers and pulled so as to easily separate the virgin seal body 11 from the cap 2. Then, the nozzle head 3 positioned at the top dead center is strongly pushed downward against a resiliency of the spring 6 to reach the bottom dead center [FIG. 10→FIG. 12].

Subsequently, when the nozzle head 3 is pushed downward, the valve seal body 51A is strongly pushed upward from the lower portion of the tip end portion 8A so that the thin portion 51A1 is ripped by this force and it is bent upward by way of the thick portion 51A2. In such a manner, the valve seal body 51A can be easily and properly removed from the valve seat 51.

At this time, an operator feels a sound of click, and easily recognizes that the opening portion 51B of the valve seat 51 is opened. Since the liquid L is always directed upward, the bent valve seal body 51A is not returned to an original state, namely, to a state to block the opening portion of the valve seat 51.

As mentioned in detail above, since the valve seal body 51A for closing the path of liquid L inside the liquid discharging apparatus when the liquid discharging apparatus is not used, there does not occur an erroneous discharge of the liquid L even if the virgin seal body 11 is inadvertently separated from the cap 2 to slightly move the nozzle head 3 up and down. The security of the liquid discharging apparatus is remarkably enhanced by a multi-stage seal construction comprising the virgin seal body 11 serving as a first stage safety valve and the valve seal body 51A serving as a second stage safety valve.

Although the invention has been explained with reference to first and second embodiment, the invention is not limited to these embodiments, and it is needless to say that the invention can be modified variously to the extent not to deviate the essence of the invention.

For example, the vertical slit of the virgin seal body 11 may be formed of a separable thin slit, a so-called perforated line in the extreme case. Particularly, if the vertical slit has a tab, the thin slit can be easily ripped when the tab is pinched and pulled.

As mentioned above, since the virgin seal body is integrated with the cap according to the liquid discharging apparatus of the invention, the liquid discharging apparatus can be simplified and the components thereof can be reduced with high efficiency.

Further, since the number of assembly of the components is made small, the liquid discharging apparatus can be manufactured at a low cost. When the liquid discharging apparatus is used, it is not necessary to turn the cap but it is sufficient to pull the virgin seal body so that time for releasing nozzle head from the fixation to the cap is not taken, realizing the liquid discharging apparatus that is extremely excellent in handling. Further, since the liquid discharging apparatus has the seal body for closing the valve seat inside the piston, a multi-stage seal construction is realized to safety.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A liquid discharging apparatus for discharging a liquid comprising:

a container for containing the liquid therein;

a cap attached to an opening of the container;

a nozzle head mounted on the cap;

a piston integrated with the nozzle head at a lower portion thereof, said nozzle head being movable up and down together with said piston, said piston defining a valve seat and including a valve seal body provided on the valve seat;

a virgin seal body integrated with the cap and positioned around a piston engagement hole formed in the cap, wherein the nozzle head is fixed to its top dead center by the virgin seal body when the liquid discharging apparatus is not in use; and a valve disposed inside a housing attached to the cap, said valve including an end portion which extends upwardly and is integral therewith, said end portion separating a portion of said valve seal body from said valve seat while another portion of the valve seal body remains connected to the valve seat when said nozzle head is pushed downwardly.

2. The liquid discharging apparatus according to claim 1, wherein the virgin seal body is cylindrical and is connected to the cap by way of a thin portion formed along the piston engagement hole.

3. The liquid discharging apparatus according to claim 2, further comprising a vertical slit defined in the virgin seal body and having a pinch portion at an opened portion thereof.

4. The liquid discharging apparatus according to claim 3, further comprising a non-slip portion at least on an outer peripheral surface of the virgin seal body at the pinch portion.

5. The liquid discharging apparatus according to claim 3, wherein the pinch portion has a cornered portion that projects outwardly.

6. The liquid discharging apparatus according to claim 3, wherein a notch is defined along the thin portion so that the virgin seal body can be easily separated from the cap.

7. The liquid discharging apparatus according to claim 4, wherein the pinch portion comprises a tab which extends outwardly at the opened portion of the vertical slit so as to be easily pinched.

8. The liquid discharging apparatus according to claim 2, wherein said valve seal body is integrally formed with said valve seat.

9. The liquid discharging apparatus according to claim 8, wherein said virgin seal body prevents inadvertent discharge of liquid from said nozzle head when said apparatus is not in use, said virgin seal body being removably attached to said cap to permit downward movement of said nozzle head when use is desired, said valve seal body being attached to said valve seat in a manner which prevents inadvertent discharge of liquid from said nozzle head after removal of said virgin seal body from said cap and prior to actual use of said apparatus.

10. The liquid discharging apparatus according to claim 9 wherein said valve seal body is attached to said valve seat by first and second connecting portions, said first connecting portion having a thickness which is substantially less than a thickness of said second connecting portion such that said end portion tears said first connecting portion upon downward movement of said nozzle head by a predetermined distance after removal of said virgin seal body and partially separates said valve seal body from said valve seat to allow liquid discharge through said nozzle head while said second portion remains intact.

11. A liquid discharging apparatus comprising:

a generally hollow container body for storing liquid therein;

a closure arrangement mounted on an upper end of said container body and including a nozzle member mounting a piston thereon, said nozzle member and said piston being movable so as to allow discharge of liquid stored in said container body through an opening defined in said nozzle member, said piston defining a valve including a valve seat and a valve body attached to said valve seat; and a valve mounted within said container body and including an upper end portion disposed adjacent said piston valve, whereby said upper end portion partially separates said valve body from said valve seat upon downward movement of said nozzle member and said piston by a predetermined distance to allow liquid stored within said container body to exit through said opening.

12. The liquid discharging apparatus of claim 11 wherein said valve body is integrally formed with said valve seat and is connected thereto by first and second connecting portions, said first connecting portion having a thickness which is substantially less than a thickness of said second connecting portion such that said upper end portion, upon downward movement of said nozzle member and said piston by said predetermined distance, tears said first portion to partially separate said valve body from said valve seat while said second connecting portion remains intact so that said valve body remains connected to said valve seat.

13. The liquid discharging apparatus of claim 12 wherein said closure arrangement includes a cap which engages said upper end of said container body and said nozzle member is slidably mounted on said cap, said apparatus further including a sealing band disposed between said nozzle member and said cap to prevent downward movement of said nozzle member and said piston.

14. The liquid discharging apparatus of claim 13 wherein said sealing band is disposed in surrounding relation with said piston and is integrally formed with said cap, said sealing band being readily separable from said cap so as to allow movement of said nozzle member and said piston.

15. The liquid discharging apparatus of claim 14 further including a tubular housing mounted within said container body and connected to said cap, said valve being disposed within said housing and said end portion thereof projects upwardly from said valve within said housing for engagement with said valve body, said cap defining therein an opening in which a lower end of said piston is slidably disposed, said sealing band being connected to an upper region of said cap in coaxial relation with said cap opening.

16. The liquid discharging apparatus of claim 11 wherein said closure arrangement includes a cap which engages said upper end of said container and said nozzle member is movably mounted on said cap, said apparatus further including a removable sealing member disposed between said cap and said nozzle member to maintain said nozzle member in an upper position prior to use of said apparatus to prevent inadvertent discharge of liquid therefrom, said sealing member being configured for removal and separation from said apparatus when use is desired to allow actuation of said nozzle member.

17. The liquid discharging apparatus of claim 16 wherein engagement of said valve body with said valve seat prevents inadvertent discharge of liquid from said nozzle member after removal of said sealing member from said apparatus and prior to downward movement of said nozzle member and said piston by said predetermined distance.

18. The liquid discharging apparatus of claim 17 wherein prior to use of-said apparatus, said valve body is attached to said valve seat by first and second connecting portions, said first connecting portion having a thickness which is substantially less than a thickness of said second connecting portion such that said upper end portion tears said first connecting portion upon downward movement of said nozzle and said piston by said predetermined distance and partially separates said valve body from said valve seat while said second connecting portion remains intact.

19. The liquid discharging apparatus of claim 16 wherein said sealing member is integrally formed with said cap and is connected thereto by a thin-walled portion to allow ready removal of said sealing member from said cap.

* * * * *